US005097589A

United States Patent [19]

Rezac et al.

[11] Patent Number: 5,097,589

[45] Date of Patent: Mar. 24, 1992

[54] METHOD OF MANUFACTURING A CIRCUIT BREAKER

[75] Inventors: Willard J. Rezac; Thomas A. Edds, both of Lincoln; Lowell D. Smith, Crete, all of Nebr.; James Early, Ballinasloe, Ireland; Martin Donnellan, Ballinasloe, Ireland; Dermot Hurst, Ballinasloe, Ireland

[73] Assignee: Square D Company, Palatine, Ill.

[21] Appl. No.: 717,867

[22] Filed: Jun. 19, 1991

Related U.S. Application Data

[63] Continuation of Ser. No. 508,861, Apr. 12, 1990, abandoned, which is a continuation-in-part of Ser. No. 373,380, Jun. 29, 1989, abandoned.

[51] Int. Cl.[5] ..... H01H 11/00

[52] U.S. Cl. ..... 29/622; 29/469; 335/175

[58] Field of Search ..... 335/172, 175; 200/293, 200/293.1; 29/622, 428, 467, 469

[56] References Cited

U.S. PATENT DOCUMENTS 4,608,546 8/1986 Westermeyer ..... 335/175 X
4,724,411 2/1988 Matsumoto et al. ..... 335/172
4,731,921 3/1988 Ciarcia et al. ..... 29/622
4,789,848 12/1988 Castonguay et al. ..... 335/172 X
4,835,842 6/1989 Castonguay et al. ..... 29/622
4,864,263 9/1989 Castonguay et al. ..... 29/622 X

*Primary Examiner*—Joseph M. Gorski
*Assistant Examiner*—S. Thomas Hughes
*Attorney, Agent, or Firm*—Larry I. Golden; Jose W. Jimenez

[57] ABSTRACT

A method of manufacturing a circuit breaker comprises the steps of preassembling the movable parts of the circuit breaker between a pair of frame members and providing a housing that is configured for supporting the unitary breaker assembly without attachments. Other circuit breaker components, attached to the unitary breaker assembly, are also supported in the housing without attachments. A cover is secured to the housing to complete the circuit breaker. Another version of the invention preassembles the movable parts of the circuit breaker and the stationary contact mechanism and trip coil, with the line and load terminals attached, between a pair of supporting frame members to form an operable circuit breaker module. The module is in turn supported in a housing without attachments. The circuit breaker module may be tested and adjusted prior to final assembly.

9 Claims, 5 Drawing Sheets

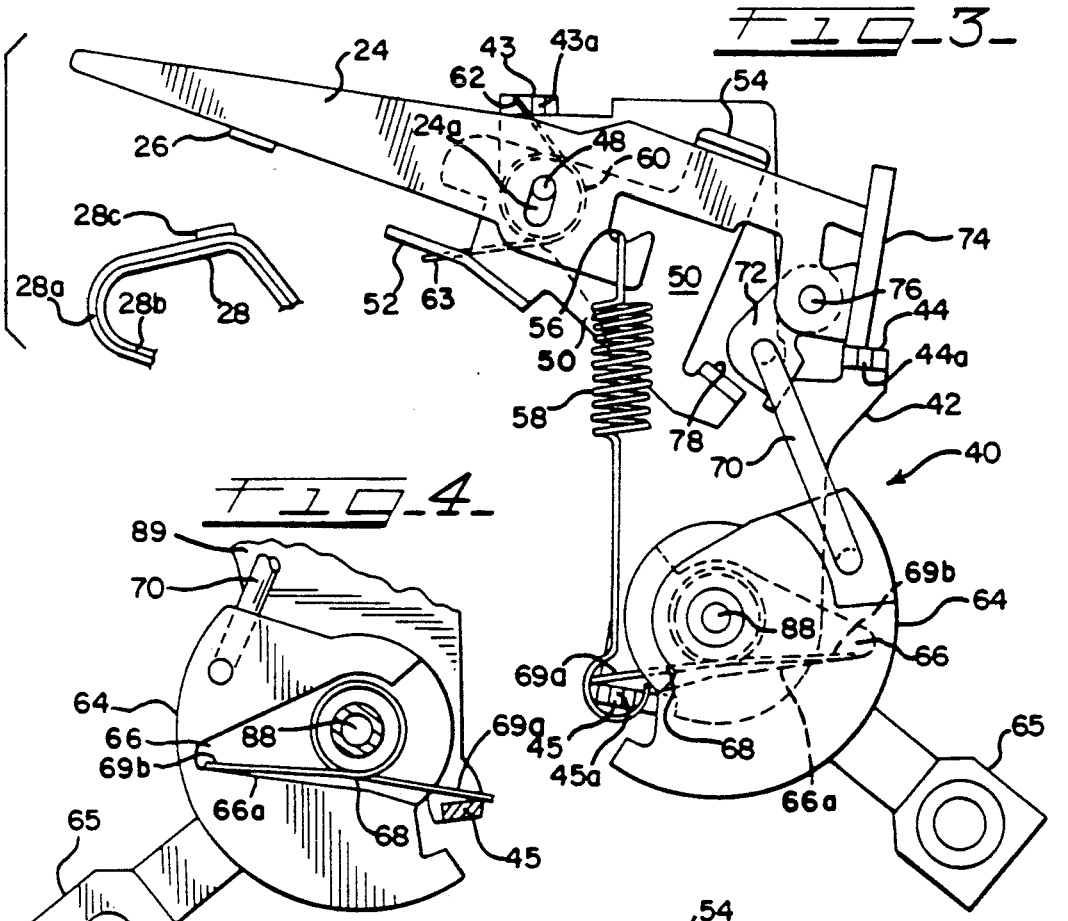
FIG. 3
FIG. 4
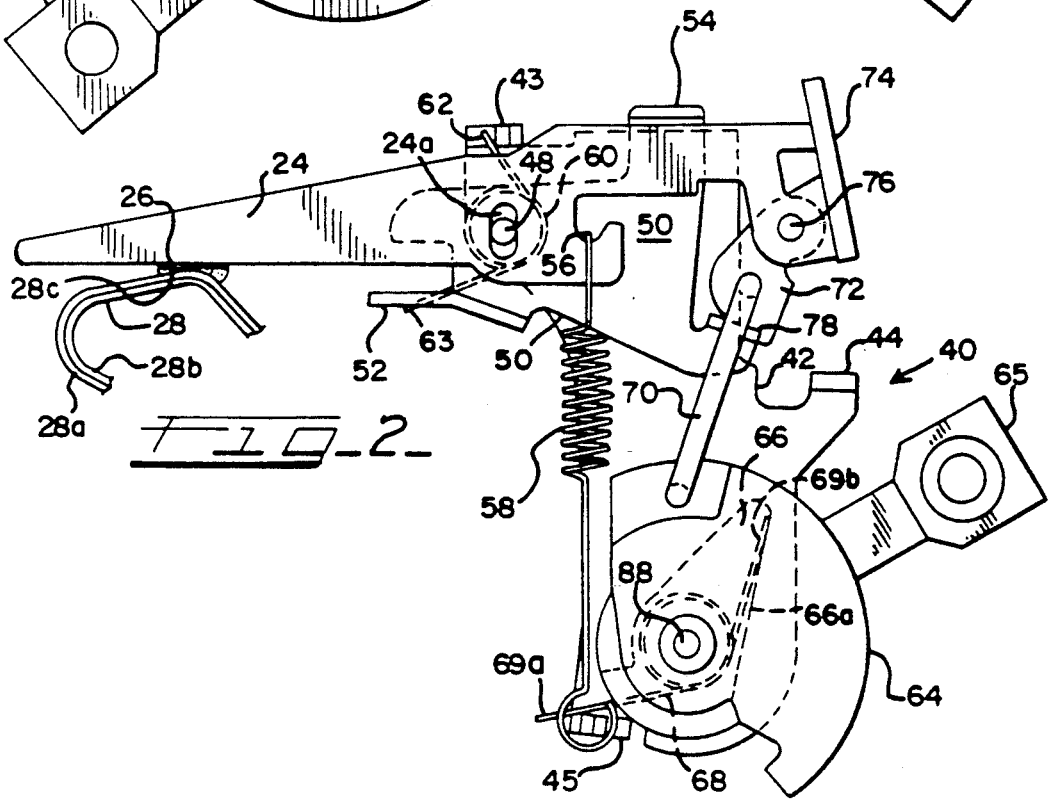
FIG. 2

METHOD OF MANUFACTURING A CIRCUIT BREAKER

CROSS-REFERENCE TO RELATED APPLICATIONS

This is a continuation of copending application Ser. No. 07/508,861 filed on Apr. 12, 1990, now abandoned which is a continuation-in-part of application Ser. No. 373,380, filed 6/29/89 (now abandoned), and discloses apparatus described and claimed in application Ser. No. 374,037, filed 6/29/89, entitled "Unitary Breaker Assembly for a Circuit Breaker," now U.S. Pat. No. 4,968,863, issued 11/6/90.

BACKGROUND OF THE INVENTION AND PRIOR ART

The invention relates to circuit breakers and, more particularly, to an improved method of manufacturing a circuit breaker.

Circuit breakers function to interrupt electrical current flow between a source of electricity and a load in response to an over-current condition. They are typically manufactured in standard sized housings and include a movable blade carrying a contact (movable contact) that is generally connected to the electrical source, a mechanism carrying a stationary contact and a spring for biasing the movable contact away from the stationary contact. A releasable latch mechanism opposes the spring bias to physically couple the movable contact and the stationary contact to permit current flow from the source to the load. A trip lever releases the latch mechanism, permitting the spring bias to separate the movable contact and the stationary contact to prevent current flow from the source to the load.

Prior art circuit breaker assemblies have one or more points of attachment to the housing. This makes preassembly of the breaker mechanism difficult because it is held together by the housing. The manufacture of prior art circuit breakers has also been difficult to automate because parts need to be assembled along three orthogonally related axes. The present invention provides a solution to these problems.

SUMMARY OF THE INVENTION

It is an object of the invention to provide an improved method of manufacturing a circuit breaker.

Another object of the invention is to provide a reliable, low cost method of manufacturing a circuit breaker.

A feature of the invention is the provision of a modular subassembly of the operating parts of a circuit breaker that may be tested and adjusted prior to installation in the breaker housing.

The inventive method involves preassembling the operative parts of a circuit breaker between a pair of frame plates that are supportable in a housing without attachment thereto. In one form of the invention, a functional circuit breaker module is assembled. The module includes the assembled working elements of the breaker, which may be independently adjusted and tested before final installation. A housing is provided for receiving and supporting the module without attachments.

BRIEF DESCRIPTION OF DRAWINGS

Other objects, features and advantages of the invention will be apparent from reading the following description in conjunction with the drawings, in which:

FIG. 2 is a partial view of the unitary breaker assembly of FIG. 1 in a closed position;

FIG. 3 is a partial view of the unitary breaker assembly of FIG. 1 in an open position;

FIG. 4 is a view of the operating handle mechanism of the unitary breaker assembly as viewed from behind;

DESCRIPTION OF THE PREFERRED EMBODIMENTS

Figure 1:
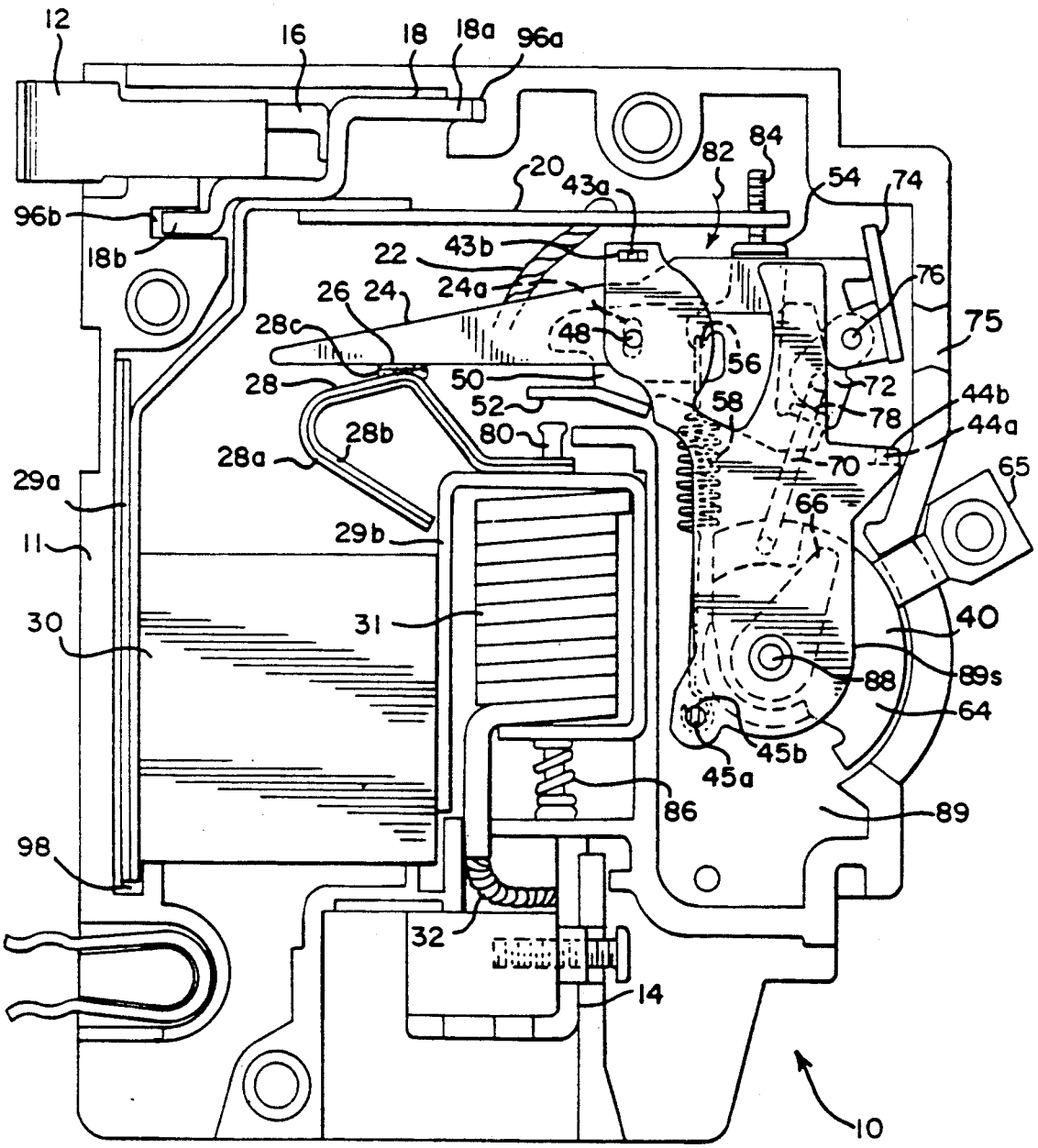
FIG. 1 is a view of a circuit breaker constructed in accordance with one aspect of the invention.

A circuit breaker 10 constructed in accordance with the first aspect of the invention is illustrated in FIG. 1. An additional description of the general features of a similar type circuit breaker can be found in the following patents, the specifications of which are incorporated herein by reference:

(a) Westermeyer, U.S. Pat. No. 4,617,540, entitled "Automatic Switch, Rail-Mounted", (b) Westermeyer, U.S. Pat. No. 4,614,928, entitled "Automatic Switch with an Arc Blast Field", (c) Westermeyer, U.S. Pat. No. 4,609,895, entitled "Automatic Switch with Integral Contact Indicator", and (d) Westermeyer, U.S. Pat. No. 4,608,546, entitled "Automatic Switch with Impact-Armature Tripping Device".

The circuit breaker 10 has a housing 11 and includes a resilient clamp type line terminal 12 for connection to a source of electricity (not shown) and a screw type load terminal 14 for connection to a load circuit (not shown). A current path is established between the line terminal 12 and the load terminal 14 which includes a line conductor 16, a support 18 for a bimetal thermal element 20, a braided pigtail 22, and a blade 24 including a movable contact 26. Continuing from the movable contact 26, the current path includes a stationary contact 28, a trip coil 31 and a load conductor 32.

The blade 24 is shown in a closed position with the movable contact 26 engaging or mating with the stationary contact 28. The blade 24 is pivotable between the closed position shown and an open position, wherein the movable contact 26 is separated from the stationary contact 28 to prevent current flow. The stationary contact 28 comprises a layer of copper **28*a* laminated to a layer of steel 28*b* with a silver/graphite composition contact 28*c* welded to the copper. The blade 24 is an element of a unitary breaker assembly, generally designated 40, which controls the position of the blade 24 relative to the stationary contact 28**.

The circuit breaker 10 also includes a lineside arc arresting plate **29*a*, a load-side arc arresting plate 29*b* and a stack of deionization plates, or arc stack, 30, which cooperate to break the electrical arc formed when the circuit breaker 10 is opened while supplying current to a load. The specific operation of the arc arresting plates 29*a*, 29*b* and the arc stack 30 iS disclosed in greater detail in the above incorporated patents. The elements 16, 18, 20 and 29***a* are joined together by welding at their various interfaces.

In FIG. 2, unitary breaker assembly 40 includes a first frame member or plate 42 having first, second and third upright members 43, 44, 45, respectively. A pivot pin 48 extends upwardly through a hole in the first frame plate 42. A trip lever 50 is pivotally supported on the pivot pin 48. The trip lever 50 includes a solenoid actuator surface 52 and a bimetal actuator surface 54. The blade 24 includes an elongated slot 24*a* for receiving the pivot pin 48. The blade 24 further includes a notch 56 to which a first end of a toggle spring 58 is attached.

A latch spring 60 is disposed about the pivot pin 48 between the trip lever 50 and the blade 24. The latch spring 60 includes a first end 62 which engages the first upright member 43 and a second end 63 which engages the solenoid actuator surface 52 of the trip lever 50. The latch spring 60 provides a counterclockwise bias to the trip lever 50.

A cam 64, having an operating handle 65 attached thereto, includes a recessed portion 66 in which a cam spring 68 is placed. Referring also to FIGS. 3 and 4, a first cam spring end 69*a* extends from recessed portion 66 and engages the third upright member 45. A second cam spring end 69*b* engages a wall of the recessed portion 66. The cam spring 68 imparts a clockwise bias to the cam 64 as viewed in FIG. 2. A link 70 couples the cam 64 to a pawl 72. The pawl 72 is pivotally connected to a flag end 74 of the blade 24 by a pin 76. The flag end is visible through a window 75 in the housing 11 (FIG. 1) and indicates the status of the circuit breaker contacts, i.e. whether they are opened or closed. The trip lever 50 further includes an engaging surface 78 which engages the pawl 72.

When in the closed position, the movable contact 26 is physically coupled to the stationary contact 28. The pin 76 operates as a fulcrum on the blade 24, causing the toggle spring 58 to keep the movable contact 26 and the stationary contact 28 closed.

Referring again to FIG. 1, the blade 24 can be moved to the open position by operation of the bimetal thermal element 20, by action of a spring loaded rod 80 disposed within the operating or trip coil 31, or by manipulation of operating handle 65. Load current passing through the bimetal thermal element 20 heats the bimetal thermal element 20 which deflects downwardly in the direction of the arrow 82. The amount of deflection depends upon the temperature reached by the bimetal thermal element 20, which is a function of the magnitude and duration of the load current. When the bimetal thermal element 20 deflects sufficiently, a calibration screw 84 engages the bimetal actuator surface 54 of the trip lever 50, causing the trip lever 50 to rotate clockwise about the pivot pin 48 and against the bias of the latch spring 60 (FIG. 3), tripping the circuit breaker 10 as discussed in greater detail below.

The circuit breaker 10 can also be tripped by the trip coil 31. The rod 80 is downwardly biased by a solenoid spring 86. Rod 80 may be coupled to, or a part of (or simply in gravitational contact with), a movable armature in coil 31. Load current passes through the coil 31 (one end of which is welded to stationary contact 28), establishing an electromagnetic field that affects the coil armature (and hence rod 80). When the electromagnetic force in coil 31 exceeds the biasing force of the solenoid spring 86, the rod 80 is moved (up) to engage the solenoid actuator surface 52, causing the trip lever 50 to rotate clockwise, tripping the circuit breaker 10, as discussed below.

Referring to FIGS. 1, 2 and 3, when either the bimetal thermal element 20 or the rod 80 causes the trip lever 50 to rotate clockwise, the engaging surface 78 of trip lever 50 moves away from pawl 72 which permits cam spring 68 to rotate cam 64 in a clockwise direction. Cam 64 pulls downwardly on the link 70, causing counterclockwise rotation of pawl 72 about pin 76. When pawl 72 is released from engagement with the engaging surface 78, blade 24 moves downwardly at its right side due to the action of toggle spring 58, initially causing the pivot pin 48 to engage the upper surface of the elongated hole 24*a*, which operates as a floating point. The pivot pin 48 then operates as a fulcrum about which blade 24 rotates, causing the toggle spring 58 to move movable contact 26 away from stationary contact 28, thus opening the circuit.

In the event that the operating handle 65 is locked in its upward, or on, position and either bimetal thermal element 20 or rod 80 causes the trip lever 50 to rotate clockwise, link 70, which is under compression between cam 64 and pawl 72, causes the pawl 72 to rotate clockwise about pin 76, again releasing the engaging surface 78 from engagement with the pawl 72. When the engaging surface 78 no longer engages the pawl 72, the blade 24 lowers, causing the pivot pin 48 to operate as a fulcrum about which the blade 24 rotates, permitting the toggle spring 58 to move the movable contact 26 away from the stationary contact 28.

The cam 64 is shown from its reverse side in FIG. 4 to better illustrate the recessed portion 66 and cam spring 68. The cam spring 68 is centered on a cam pivot axis 88. The second cam spring end 69*b* is biased against wall 66*a* of the recessed portion 66. The first cam spring end 69*a* is biased by torsion loading against the third upright member 45. The torsion loading of the cam spring 68 urges the cam 64 and attached operating handle 65 in the downward position.

Figure 5:
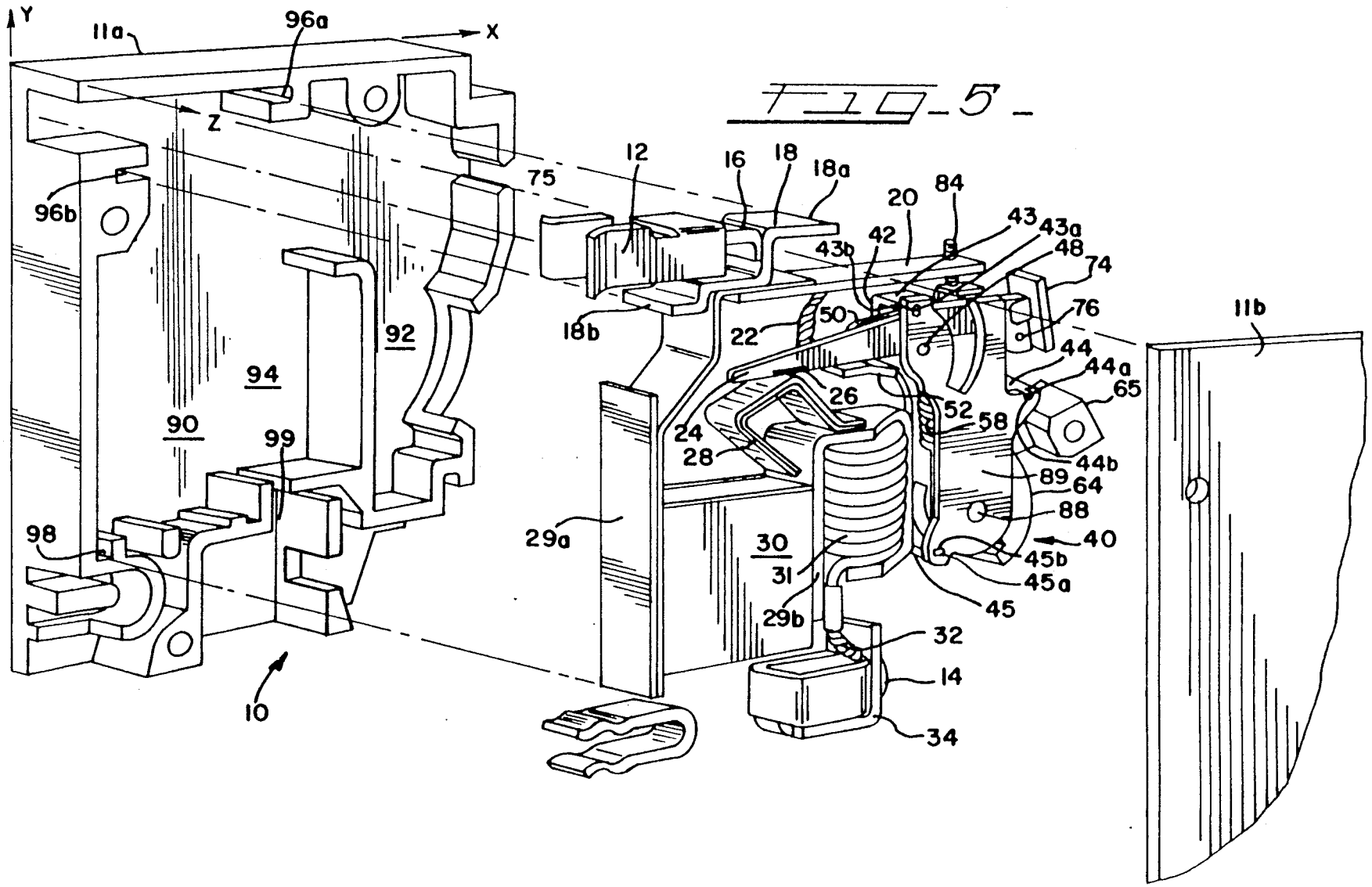
FIG. 5 is an exploded perspective showing assembly of the circuit breaker of FIG. 1.

The circuit breaker 10 is illustrated in an exploded perspective view in FIG. 5. The first, second and third upright members 43, 44, 45 of the first frame plate 42 terminate in connecting tabs 43*a*, 44*a*, 45*a*, respectively. A second frame plate 89 includes corresponding tab receiving openings 43*b*, 44*b*, 45*b* which provide an interference fit with the respective connecting tabs 43*a*, 44*a*, 45*a* to secure the first frame plate 42 to the second frame plate 89. In this embodiment of the invention, the first and second frame plates 42, 89, respectively, are separate pieces; however it is to be understood that the frame plates could be formed from a single piece folded over to form the opposing frame surfaces.

With the first frame plate 42 secured to the second frame plate 89, it will be noted that all elements of the unitary breaker assembly 40 are secured together. As illustrated, the unitary breaker assembly and other individual components of the circuit breaker 10 are simply installed into the circuit breaker base 11*a* and require no attachments thereto.

The housing 11 has a base 11*a* and a cover 11*b*. The base 11*a* defines x, y and z axis supporting elements and surfaces. These include internal and external walls and parts that are perpendicular to the base 11*a*, i.e. extend along the z-axis. The elements define an arc stack section 90, a unitary breaker assembly section 92 and a coil section 94 as well as support slots such as 96*a* and 96*b*.

End portions 18*a* and 18*b* of the bimetal support 18 are slid into and retained within respective support slots 96*a* and 96*b*. The line-side arc arresting plate 29*a* is slid into and retained within an arc runner slot 98. The unitary breaker assembly 40 is then simply placed in the unitary breaker assembly section 92, and requires no attachments to the housing 11. Suitably placed and configured additional indentations and protrusions (not shown) may be incorporated in base 11*a* and cover 11*b* for assuring adequate support for the various elements, if desired. The load terminal 14 is slid into and retained in a load terminal compartment 99. Suitable fasteners, not shown, are used to secure cover 11*b* in place on base 11*a* and thereby retain the elements of the circuit breaker in housing 11. The blade 24 is a tapered plate on edge, operating structurally as a beam so as to prevent flexing. If additional current carrying capacity is required, the width of the blade 24 may simply be increased.

Figure 6:
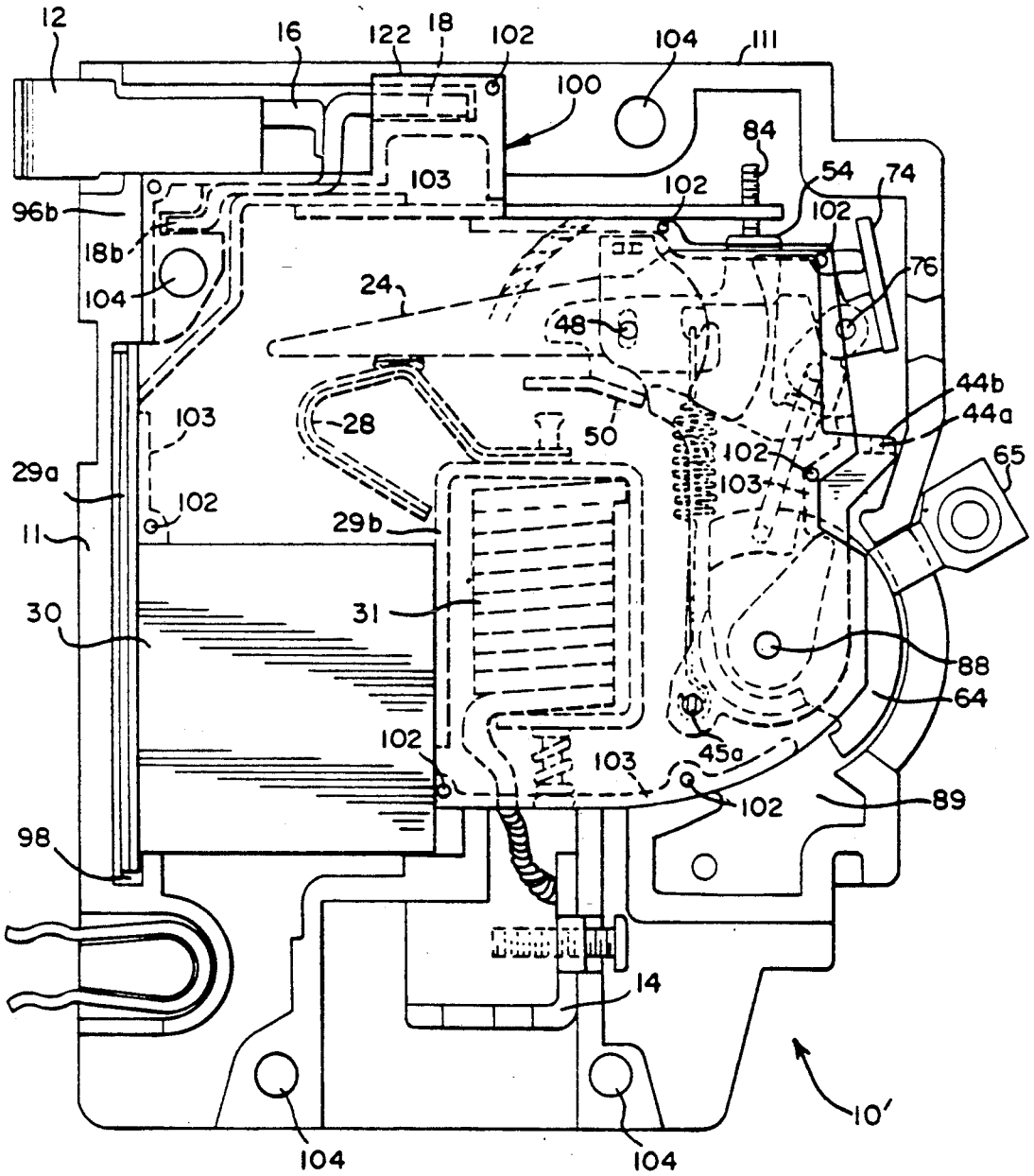
FIG. 6 is a view of a circuit breaker constructed in accordance with another aspect of the invention.
Figure 7:
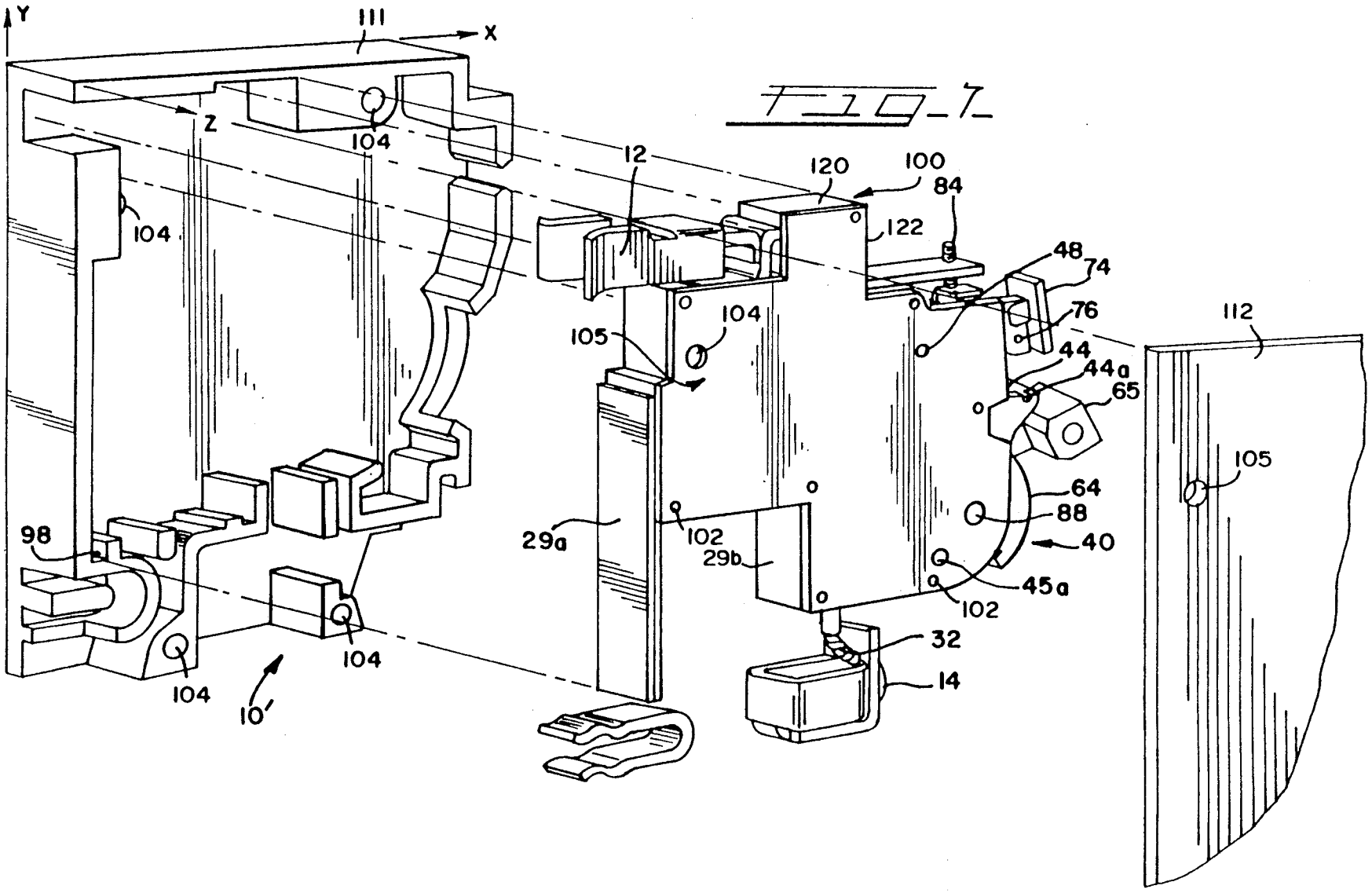
FIG. 7 is an exploded perspective showing assembly of the circuit breaker of FIG. 6.

The embodiment of the invention illustrated in FIGS. 6 and 7 provides a very attractive solution for a circuit breaker manufacturer who wishes to do final assembly of circuit breakers at different locations. The operative parts of the circuit breaker, including the unitary breaker assembly and the trip coil and stationary contact, are preassembled into a module that may be tested and calibrated before final installation in the breaker housing. Therefore, the critical manufacturing steps may be carefully controlled where the modules are constructed.

In FIG. 6, circuit breaker 10′ has a base 111 that is modified to accept a module 100 without the need of fasteners. Module 100 has a pair of supporting side plates or frame members (only one of which-105-is visible) that function to support the movable elements for operation as was accomplished by the frame members 42 and 89 above. That is, one of the side plates of module 100 has an internal configuration that cooperates with the other side plate to operatively support the working elements of the circuit breaker. As illustrated by the dotted line wall portions 103 and the fastener points 102, the frame members are configured to provide suitable openings for parts of the circuit breaker that extend outside the module which includes the unitary breaker assembly and the trip coil assembly. These parts include the cam 64, operating handle 65, line terminal 12, load terminal 14, flag end 74, calibration screw 84 and line and load side arc plates 29*a* and 29*b*. Thus the essential mechanism of the breaker may be handled and tested as a separate module 100. The frame members are preferably made of plastic with suitable interior coatings or barrier plates adjacent to the contact areas to withstand the effects of heating due to opening and closing of the contacts under load. The frame members also support the pivot pins 48 and define the pivot axis 88. The differences between this embodiment and that described in FIGS. 1-5 are that the stationary contact and trip coil and the bimetal and calibration screw are also secured in their final positions by the module 100, which permits full operation and adjustment of the breaker before installing it in housing 111. All that needs to be added during final assembly is the arc chute 30. Securing the trip coil and stationary contact and the thermal element support 18 in module 100 renders the unitary breaker assembly capable of full operation apart from housing 111 and cover 112 and represents a preferred implementation of the invention.

In FIG. 7, the internal configuration of base 111 for supporting module 100 (without fasteners) is shown. It will be appreciated that suitable fasteners (not shown) are used to secure module 100 between base 111 and cover 112 via apertures 104 and 105. It will also be noted that the particular configuration of the base, cover and module is dependent upon the specific breaker construction.

Thus it can be seen that a unitary breaker assembly has been provided which can be preassembled and which requires no attachments to secure it within a circuit breaker housing. In addition, assembly of the unitary breaker assembly can readily be automated, because the assembly steps are performed along a single axis.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of manufacturing a circuit breaker comprising the steps of:

providing a housing defining support means;

providing a preassembled module containing an operating mechanism of a circuit breaker including a stationary contact and a movable contact, movable between an open position and a closed position with said stationary contact, a strip mechanism and an operating handle having electrical connection means;

adjusting and testing said preassembled module; and installing said adjusted and tested module and said electrical connection means in said housing.

2. A method of manufacturing a circuit breaker having a movable load contact and a stationary load contact comprising the steps of:

preassembling a module, comprising movable parts of said circuit breaker, and said stationary load contact, said module being capable of being adjusted and tested before installation in a housing;

providing a housing defining at least one compartment configured to support said module without attachment to said module;

testing said module;

placing said tested module into said compartment; and securing a cover to said housing.

3. The method of claim 2 wherein said housing includes a second compartment for supporting an individual component of said circuit breaker and further including the step of placing said individual component of said circuit breaker in said second compartment before securing said cover.

4. The method of claim 4 wherein a stationary electrical connector is connected to said module and wherein said housing includes support means for supporting said stationary electrical connector.

5. The method of claim 3 wherein said individual component comprises a deionization plate assembly.

6. A method of manufacturing a circuit breaker comprising the steps of:

preassembling a module, including a pair of side plates, supporting a movable contact mechanism, stationary contact, an operating handle ad a trip mechanism, said module being capable of adjustment and testing before installation in a housing;

providing a breaker housing defining a plurality of compartments for supporting component parts of said circuit breaker, including said module, without attachments between said component parts and said housing;

testing said module;

placing said tested module and said compartment parts of said breaker into corresponding compartments in said housing; and securing a cover to said housing.

7. The method of claim 7 wherein said module further includes an operating coil connected to said stationary contact and wherein said component parts also include an electrical terminal, said housing providing support for said stationary contact and said operating coil and for said electrical terminal.

8. The method of claim 7 wherein said component parts include a deionization plate assembly and another electrical terminal and wherein said housing provides support for said deionization plate assembly and said another electrical terminal.

9. The method of manufacturing a circuit breaker comprising the steps of:

preassembling movable parts of a circuit breaker, including a movable load contact, and a stationary load contact, into a module comprising a pair of side plates operatively supporting said movable parts and said stationary load contact, said module being capable of adjustment and testing before installation in a housing;

providing a housing including means for supporting said module without attachments between said module and said housing;

testing said module;

installing said tested module in said housing; and securing a cover to said housing.

* * * * *